United States Patent [19]

Tremmel et al.

[11] 4,299,671

[45] Nov. 10, 1981

[54] BATH COMPOSITION AND METHOD FOR ELECTRODEPOSITING COBALT-ZINC ALLOYS SIMULATING A CHROMIUM PLATING

[75] Inventors: Robert A. Tremmel, Woodhaven; Walter J. Wieczerniak, Utica, both of Mich.

[73] Assignee: Hooker Chemicals & Plastics Corp., Warren, Mich.

[21] Appl. No.: 159,402

[22] Filed: Jun. 13, 1980

[51] Int. Cl.[3] ..... C25D 3/56; C25D 5/48

[52] U.S. Cl. ..... 204/35 R; 204/38 R; 204/43 Z

[58] Field of Search ..... 204/43 Z, 43 T, 123, 204/35 R, 38 R

[56] References Cited

U.S. PATENT DOCUMENTS 3,881,919 5/1975 Hyner et al. ..... 204/43 S X 4,035,249 7/1977 Wieczerniak ..... 204/43 S

FOREIGN PATENT DOCUMENTS 254296 10/1969 U.S.S.R. ..... 204/43 Z

*Primary Examiner*—G. L. Kaplan

*Attorney, Agent, or Firm*—Richard P. Mueller

[57] ABSTRACT

A bath composition and method for electrodepositing a cobalt-zinc alloy on a conductive substrate which simulates the appearance of a conventional chromium electrodeposit. The bath comprises an aqueous solution having a pH of about 6 to about 9 containing a controlled ratio of cobalt ions and zinc ions and a complexing agent sufficient to maintain the cobalt and zinc ions in solution. The bath and method are particularly adaptable for rack plating articles to impart a decorative bright chromium-like appearance and semi-bright deposits simulating conventional chromium platings.

40 Claims, No Drawings

BATH COMPOSITION AND METHOD FOR ELECTRODEPOSITING COBALT-ZINC ALLOYS SIMULATING A CHROMIUM PLATING

BACKGROUND OF THE INVENTION

The difficulties associated with the consistent electrodeposition of bright, conventional chromium deposits coupled with the imposition of government restrictions on the discharge of toxic effluents including hexavalent chromium present in conventional chromium electroplating baths has prompted the development of alternative electroplating bath compositions and techiques for depositing metal alloys intended to duplicate the color and characteristics of conventional chromium deposits. In U.S. Pat. No. 3,881,919, for exaple, an electroplating bath is disclosed for depositing a ternary alloy consisting of cobalt, tin and zinc which simulates a chromium deposit. In U.S. Pat. No. 4,035,249 which is assigned to the same assignee as the present invention, an electroplating bath composition is disclosed for depositing a binary alloy consisting of cobalt and tin. The bath composition and process as disclosed in the last mentioned U.S. patent is primarily adapted for the bulk plating of small workpieces such as in barrels and some difficulty has been encountered in adapting the bath for rack plating of workpieces.

While the various alloy electrodeposits suggested in accordance with such prior art patents have produced platings which simulate a conventional chromium electrodeposit, the resulting deposits and the process for their electrodeposition have had shortcomings detracting from a more widespread commercial acceptance thereof. For example, such alloy deposits have lacked the necessary corrosion resistance under moderate exposure conditions resulting in tarnish or color change. The hardness of such alloy deposits has also been substantially lower than that of a conventional chromium deposit. An increase in the corrosion resistance of such alloy deposits by the application of thicker electrodeposits has been limited due to the loss of chromium-like appearance necessitating the use of relatively thin electrodeposits in the order of about 0.02 to about 0.03 mils (0.00002 to about 0.00003 inch). Additionally, difficulties have been encountered in maintaining proper bath stability particularly in electrolytes containing stannous ions because of their tendency to become oxidized to the stannic state.

The bath composition and method of the present invention overcomes many of the problems associated with prior art compositions and methods for applying simulated chromium electrodeposits by providing a bath composition which is relatively easy to control, is stable, and is versatile in use for both rack and bulk plating processes. Additionally, the chromium-like deposit is possessed of increased hardness and corrosion resistance and can be deposited in thicknesses as high as 1 mil (about 25 micrometers) without encountering an adverse color change or a spongy physical structure. The alloy electrodeposit of the present invention can further be improved in its corrosion and tarnish resistance by the application of a passivating rinse following electrodeposition, such as a chromium rinse.

SUMMARY OF THE INVENTION

The benefits and advantages of the present invention are achieved in accordance with its composition aspects, by an electrolyte comprising an aqueous solution having a pH ranging from about 6 to about 9 and containing as its essential constituents, a controlled ratio of cobalt ions and zinc ions in combination with a complexing agent present in an amount sufficient to maintain the cobalt and zinc ions in solution. The concentration of the cobalt ions may broadly range from about 1 to about 12 grams per liter (g/l); the zinc ions can be present in an amount from about 0.75 to about 9 g/l and the complexing agent can be present in an amount usually ranging from about 10 to about 100 g/l, depending on the particular concentration of cobalt and zinc ions present in the bath. The concentration of the cobalt and zinc ions in the bath is controlled at a ratio such that the electrodeposit contains from about 75% to about 85% zinc and the balance cobalt with an alloy deposit containing about 80% zinc and 20% cobalt being most satisfactory.

The complexing agent preferably comprises citric acid including the alkali metal, ammonium, zinc and cobalt salts thereof. Gluconic acid, alpha glucoheptonic acid, tartaric acid, as well as the alkali metal, ammonium, zinc, and cobalt salts thereof, can also be employed preferably in combination with at least 10% of the citric acid complexing compound.

In accordance with the method aspects of the present invention, a cobalt-zinc alloy simulating a conventional chromium electrodeposit is plated on a conductive substrate employing the bath composition as hereinabove described at temperatures ranging from about 60° to about 90° F. about 15° to about 32° C.) at current densities ranging from about ½ to about 30 amperes per square foot (ASF) for time periods usually ranging from as little as 30 seconds up to about 1 hour or more depending upon the thickness of the electrodeposit desired. The electrodeposited substrate incorporating the cobalt-zinc alloy thereon can be further subjected to a passivating treatment, if desired, by contacting it with an aqueous rinse solution containing a dulute concentration of chromium to further improve the tarnish and corrosion resistance of the deposit. Particularly satisfactory results are obtained when employing the bath composition and method of the present invention for rack plating workpieces comprised of or having a surface layer of, bright nickel, bright cobalt, bright nickel-iron alloy, polished brass, polished copper and polished steel to form a bright or semi-bright plate having a decorative appearance simulating that of a conventional chromium deposit.

Additional benefits and advantages of the present invention will become apparent upon a reading of the description of the preferred embodiments taken in conjunction with the specific examples provided.

DESCRIPTION OF THE PREFERRED EMBODIMENTS

According to the composition aspects of the present invention, the aqueous electrolyte contains as its essential constituents, a controlled ratio of cobalt ions and zinc ions, a complexing agent present in an amount sufficient to maintain the cobalt and zinc ions in solution; an alkaline or acidic pH adjusting agent, if necessary, to provide a bath pH of about 6 to about 9; and optionally, bath soluble and compatible conductivity salts for improving bath conductivity and efficiency. The cobalt and zinc ions can be introduced into the bath employing any bath soluble compatible salt including the cobalt and zinc salts of the complexing agents employed. Typically, the sulfate salts and halide salts such as cobalt and zinc chloride can be used. For example, the cobalt can be introduced as cobalt sulfate heptahydrate ($CoSO_4.7H_2O$) which comprises the preferred and commercially available material although cobalt ammonium sulfate can also be employed. Typically, the zinc ions are introduced as zinc sulfate monohydrate ($ZnSO_4.H_2O$), which is a commercially preferred material.

The concentration of the cobalt ions in the aqueous bath may broadly range from about 1 g/l to about 12 g/l while amounts of from about 3 to about 8 g/l are commerically preferred. A particularly satisfactory concentration of cobalt ions is about 4 g/l. At cobalt ion concentrations below about 1 g/l, an undesirable loss in bath efficiency and consistency in the electrodeposit characteristics is encountered in some instances. On the other hand, concentrations of cobalt above about 12 g/l are undesirable due to the tendency to form dark surface areas in the high current density portions of a workpiece and such high concentrations also require excessive amounts of the organic complexing agents which are susceptible to degradation and detract from the stability of the bath. For these reasons, cobalt ion concentration of about 3 to about 8 g/l are preferred for commercial operations permitting the use of a wide range of current densities while consistently producing satisfactory chromium-like electrodeposits.

The concentration of the zinc ions in the aqueous electrolyte can broadly range from about 0.75 up to as high as 9 g/l with amounts of about 2.5 to about 6 g/l being preferred from a commercial standpoint. Particularly satisfactory results are obtained at a zinc ion concentration of about 3.5 g/l in combination with a cobalt ion concentration of about 4 g/l at which ion concentration only moderate amounts of complexing agent are required to maintain such ions in solution providing for excellent stability, efficiency and simple control of the bath from a commercial standpoint. Zinc ion concentrations above about 9 g/l are undesirable in that in some instances, the electrodeposit obtained has light or white blotches over selected areas thereof, detracting from the chromium-like appearance thereof. At concentrations below about 0.75 g/l, loss in bath efficiency and consistency in the electrodeposit applied is sometimes incurred. For these reasons, the zinc ion concentration is preferably controlled within a range of about 2.5 to about 6 g/l with a concentration of about 3.5 g/l being particularly satisfactory.

It is important in order to achieve a satisfactory chromium-like electrodeposit, that the concentration of the cobalt and zinc ions in the aqueous electrolyte be controlled in relationship to the amount of the two ions present so as to electrodeposit an alloy containing from about 75 to about 85% by weight zinc and the balance essentially cobalt. Ideally, the ratio of cobalt and zinc ions present in the bath in consideration of the pH, temperature, current density and configuration of the article being plated is controlled so as to produce a cobalt-zinc alloy deposit containing about 80% by weight zinc and 20% cobalt. Under the preferred bath composition and operation conditions, it has been found that a concentration of cobalt ions of about 4 g/l and a concentration of zinc ions of about 3.5 g/l, a pH of about 8, an electrolyte temperature of about 75° F. (24° C.) and a current density of about 10 to about 15 ASF effects an electrodeposition of a cobalt-zinc alloy containing about 80% zinc and about 20% cobalt. Under these conditions, the relative concentrations of cobalt and zinc ions in the electrolyte corresponds to a mol weight ratio of about 1:1. The molar ratio of the cobalt and zinc ions in the electrolyte can be varied somewhat from the preferred embodiment of about 1:1 whereby the mol ratio of cobalt to zinc ions can range from about 0.8 up to about 1.2:1 with a mol ratio of about 0.9 up to about 1.1:1 being preferred. In any event, appropriate adjustments in the bath pH, temperature, current density, and remaining plating parameters should be controlled so as to produce an electrodeposit containing from about 75 to 85% by weight zinc and preferably, about 80% zinc and 20% cobalt.

In addition to the cobalt and zinc ions, the electrolyte contains a controlled amount of an organic complexing agent present to maintain substantially all of the cobalt and zinc ions in solution. Complexing agents which have been found suitable in accordance with the practice of the present invention include citric acid, gluconic acid, alpha glucoheptonic acid, tartaric acid, as well as the alkali metal, ammonium, zinc, cobalt salts thereof. Of the foregoing, citric acid or the citric acid salts constitutes the preferred material. The use of citric acid and/or a citrate salt constitutes the preferred practice for electrodepositing a cobalt-zinc alloy employing rack plating techniques. On the other hand, sodium glucoheptonate appears to provide the best results when the bath is employed for bulk plating of workpieces in an electroplating barrel. The use of the alternative complexing agents and/or the salts thereof for rack plating have been found suitable for electrodepositing a cobalt-zinc alloy at a plating thickness less than about 0.1 mil. However, when electroplating the cobalt-zinc alloy in amounts greater than 0.1 mil, such alternative complexing agents have been noted to produce dark and spongy deposits in some instances, necessitating the addition of citric acid or a citrate salt in combination with the alternative complexing agent to overcome this problem. Generally, the use of the citrate complexing agent in an amount of at least about 10% of the total complexing agent present in the bath or, in amounts of at least about 5 to 10 g/l in the electrolyte provides satisfactory electrodeposits of a relatively high thickness. For the rack plating of conductive substrates employing the most preferred conditions as hereinabove described, citric acid itself present in an amount of about 40 g/l has been found most desirable.

The concentration of the complexing agent in the electrolyte may range from about 10 up to about 100 g/l with concentrations ranging from about 20 to about 75 g/l being preferred. The concentration of the complexing agent in terms of g/l are expressed in terms of the weight equivalent basis to citric acid itself. The specific quantity of complexing agent employed is controlled in relationship to the quantity of cobalt and zinc ions present in the bath and is employed preferably in an amount slightly in excess of that required to maintain these ions in solution. The use of a substantial excess of the complexing agent has been found undesirable under certain bath operating conditions due to the tendency of such excess to result in the deposition of a zinc-cobalt alloy containing in excess of about 85% zinc.

The aqueous electrolyte is controlled within a pH of about 6 to about 9 with a pH of about 8 being most preferred. If necessary, the bath can be adjusted to within the required pH operating range employing an alkaline agent such as an alkali metal hydroxide or ammonium hydroxide which constitute the preferred materials. Acidic pH adjusting agents include sulfuric acid or any of the carboxy-hydroxy organic acids hereinabove set forth as complexing agents such as citric acid, gluconic acid, and the like.

In addition to the foregoing constituents, the bath can further optionally contain bath soluble and compatible salts to improve the conductivity of the electrolyte. Such conductivity salts include alkali metal and ammonium sulfate salts which are preferred for use with insoluble anodes. Additionally, alkali metal and ammonium halide salts such as ammonium chloride, for example, can also be employed to enhance bath conductivity when soluble anodes are employed. Preferably, the sulfate salts are used. When employed, such conductivity salts can range up to about 50 g/l or higher with concentrations of about 20 to about 40 g/l being typical. The use of such conductivity salts is not normally necessary but their use in the preferred range has been found to improve bath conductivity and to also provide a slight improvement in the appearance of the electrodeposit formed.

In accordance with the method aspects of the present invention, the aqueous electrolyte is controlled within a temperature range of about 60° (15° C.) to about 90° F. (32° C.) with a temperature of about 70° F. (21° C.) to about 80° F. (27° C.) being commercially preferred. Particularly satisfactory results are obtained at a temperature of 75° F. (24° C.). Bath temperatures in excess of about 90° F. have been found in some instances to produce a blotchy gray-white sandy or rough electrodeposit and for this reason it is preferred to maintain bath temperature at a level less than about 90° F. Temperatures below about 60° F. are impractical from a commercial standpoint.

The aqueous electrolyte can be operated over a broad range of current densities including as low as about one-half ASF to about as high as 30 ASF or higher. From a commercial standpoint, current densities of about 10 to about 15 ASF are preferred. During the electrodeposition step, agitation of the bath is ordinarily not required. For rack plating, cathode rod agitation is preferred with bulk plating providing agitation by use of an electroplating barrel.

The duration of electrodeposition will vary depending upon bath composition, current density and the thickness of the electrodeposit desired. Normally, for relatively thin bright decorative chromium-like deposits ranging in thickness from about 0.01 up to about 0.05 mil, plating times of from about 30 second to about 15 minutes at current densitites of about 10 to about 15 ASF can be used. For relatively heavier chromium-like deposits, plating times of up to about one hour or more can be employed producing plating thicknesses ranging from about 0.1 up to about 0.25 mil (2.5 to about 6 micrometers). Heavy electrodeposits in excess of 1 mil (greater than 25 micrometers) can also be deposited producing a uniform deposit but wherein some of the luster or brightness of the plating is sacrificed.

The article to be plated can be cathodically electrified employing a soluble anode such as a zinc, cobalt or zinc-cobalt alloy anode. An insoluble anode can also be employed comprised of carbon, graphite or stainless steel. Preferably an insoluble stainless steel anode is used.

The bath and method of the present invention is further characterized by its versatility, ease of control and stability and is particularly adaptable for rack plating of articles, particularly those having a surface layer of nickel, cobalt, a nickel-iron alloy, brass, copper or steel. When depositing the cobalt, zinc alloy as a decorative chromium-like deposit in thicknesses of about 0.01 to about 0.05 mil, the final deposit takes on the character of the surface layer on which it is plated. For example, if the surface is a bright nickel, bright cobalt, bright nickel-iron alloy, bright copper, or polished brass or steel, the resultant cobalt-zinc alloy deposit simulates a bright chromium-like plating. On the other hand, if the surface is dull or a semi-bright surface, the resultant decorative cobalt-zinc alloy is characterized as having a chromium-like dull or semi-bright appearance. Regardless of the type of substrate, as the cobalt-zinc deposit increases in thickness, approaching a relatively heavy plating of greater than about 1 mil, a generally uniform electrodeposit is attained, accompanied by a loss of some of the luster.

In order to further illustrate the composition and method aspects of the present invention, the following examples are provided. It will be understood that examples are provided for illustrative purposes and are not intended to be limiting of the scope of the invention as herein described and as set forth in the subjoined claims.

EXAMPLE 1

An aqueous electrolyte is prepared containing 20 g/l cobalt sulfate heptahydrate, 10 g/l zinc sulfate monohydrate, and 50 g/l citric acid. The pH of the electrolyte is adjusted to 8.2 with ammonium hydroxide.

The electrolyte is controlled at a temperature of about 80° F. and a bent S-shaped steel panel is plated with 0.2 mils of bright nickel and then plated in the foregoing cobalt-zinc electroplating bath for 2½ minutes at 20 ASF. The resulting cobalt-zinc alloy deposit has an excellent chromium color and the plate is uniformly bright over the entire panel.

EXAMPLE 2

An identical S-shaped steel panel having a 0.2 mil bright nickel electrodeposit thereover is plated with the same cobalt-zinc electrolyte as described in Example 1 at pH 8.2 and at a temperature of 80° F. for a period of 10 minutes at 15 ASF. The resulting electrodeposit has an excellent chromium color and is bright over the entire panel. An analysis of the cobalt-zinc electrodeposit reveals it to contain about 80% zinc and 19.8% by weight cobalt.

EXAMPLE 3

An aqueous electrolyte is prepared as in Example 1 but 50 g/l gluconic acid is employed as a substitute for the citric acid complexing agent. Employing the identical conditions as set forth in Example 1, a cobalt-zinc electrodeposit is obtained on the S-shaped nickel plated steel panel, identical to those obtained in Example 1.

EXAMPLE 4

An aqueous electrolyte containing cobalt-zinc is prepared as in Example 1 but containing 50 g/l tartaric acid in lieu of the citric acid complexing agent employed in Example 1. The bath under the identical conditions as described in Example 1 results in a uniform bright deposit having excellent chromium color on the nickel plated S-shaped steel panel.

EXAMPLE 5

An aqueous cobalt-zinc electrolyte is prepared as in Example 1 but wherein 50 g/l of alpha glucoheptonic acid is employed instead of the citric acid complexing agent. Under the identical conditions described in Example 1, a uniformly bright electrodeposit having excellent chromium color is produced on the nickel plated S-shaped steel panel.

The cobalt-zinc electrodeposits produced under the conditions of Examples 1, 3, 4 and 5 are typical of relatively thin decorative chromium-like deposits having a thickness of less than about 0.1 mil. The electrodeposit of Example 2 is typical of a heavier cobalt-zinc deposit of a thickness greater than about 0.1 mil under the time and current density conditions employed.

EXAMPLE 6

The aqueous cobalt-zinc electrolyte of Example 3 containing gluconic acid is employed for electrodepositing on a nickel plated S-shaped steel panel a cobalt-zinc alloy employing the conditions as set forth in Example 2, i.e., 10 minutes at 15 ASF. An examination of the electrodeposit reveals an objectionable gray color in the high current density areas and an overall darker color than the plating obtained in accordance with Example 2. By the addition of 5 g/l of citric acid to the gluconic acid containing electrolyte followed by a re-adjustment of the pH to about 8.2 with ammonium hydroxide, a plating of a similar nickel plated S-shaped steel panel produced a cobalt-zinc electrodeposit which was uniformly bright over the entire panel and had an excellent chromium color similar to that obtained in accordance with Example 2.

EXAMPLE 7

An electrolyte is prepared as in Example 5 containing 20 g/l cobalt sulfate heptahydrate, 10 g/l zinc sulfate monohydrate and 50 g/l sodium glucoheptonate which was employed for electroplating a nickel plated S-shaped steel panel under the conditions as set forth in Example 2. The heavier plate deposit was similar to that obtained in Example 5 employing the bath devoid of citric acid in that it had an undesirable gray appearance in the high current density areas and an overall darker color. Here again, the addition of 5 g/l of citric acid followed by a re-adjustment of bath pH to 8.2 with ammonium hydroxide employing the same conditions; i.e., 10 minutes plating at 15 ASF produced a uniformly bright cobalt-zinc alloy plating having an excellent chromium color, equivalent to that obtained in accordance with Example 2.

EXAMPLE 8

An aqueous cobalt-zinc electrolyte is prepared as in Example 7 but containing 50 g/l tartaric acid instead of sodium glucoheptonate. A nickel plated S-shaped steel panel is plated for 10 minutes at 15 ASF in accordance with the conditions of Example 2. The resultant cobalt-zinc electrodeposit is observed as being more gray in color than that obtained in accordance with Example 6 employing gluconic acid alone. The addition of 10 g/l of citric acid in combination with the 50 g/l tartaric acid followed by pH adjustment resulted in the deposition on a similar S-shaped steel panel of a cobalt-zinc electrodeposit which was of uniform brightness over the entire surface and had an excellent chromium-like appearance equivalent to that obtained in Example 2.

The cobalt-zinc alloy deposits produced in accordance with the present invention and the specific Examples exhibit increased hardness approaching that of decorative chromium deposits particularly of the type produced employing trivalent chromium plating baths. The ability to obtain thicker cobalt-zinc alloy deposits also significantly improves the abrasion resistance of such platings. It has also been discovered, that improved tarnish resistance of such cobalt-zinc alloy platings can be achieved by subjecting the cobalt-zinc plating to a passivation treatment following the plating operation. The improvement in tarnish resistance of such has been substantiated by neutral salt spray tests of the types conventionally employed for nickel plating deposits which typify a mild to moderate exposure condition. In accordance with the preferred practice of the present invention, the passivation of the cobalt-zinc alloy plating is achieved following a water rinsing of the plated article employing a dilute aqueous chromium rinse solution typically containing from about 3 to about 15 g/l of a chromate or dichromate salt. The rinse solution is usually controlled at a temperature ranging from about 60° to about 120° F. and is carried out for a period of about 5 to about 30 seconds. These results are somewhat surprising in that a similar passivation treatment of a cobalt-tin alloy such as produced in accordance with the method disclosed in U.S. Pat. No. 4,035,249 has little or no affect on the tarnish resistance of such cobalt-tin alloy deposits.

EXAMPLE 9

The S-shaped steel panel having a nickel plating and a cobalt-zinc electroplating thereover as produced in accordance with Example 1 is water rinsed with tap water and is further subjected to a dilute chromium rinse treatment employing a solution containing about 10 g/l of sodium dichromate at a temperature of 80° F. for a period of 15 seconds. The passivated panel was thereafter water rinsed.

Neutral salt spray evaluations reveal superior tarnish resistance over the same test panel without the chromium passivation treatment.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. An aqueous bath composition for electrodepositing a cobalt-zinc alloy, which bath is substantially free of tin ions and contains about 1 to about 12 g/l cobalt ions, about 0.75 to about 9 g/l zinc ions, and a complexing agent present in an amount sufficient to maintain said cobalt and zinc ions in solution, which bath has a pH of about 6 to about 9.

2. The bath composition as defined in claim 1 im which said cobalt ions are present in an amount of about 3 to about 8 g/l and said zinc ions are present in an amount of about 2.5 to about 6 g/l.

3. The bath composition as defined in claim 2 in which said complexing agent is present in an amount of about 20 to about 75 g/l, calculated as a weight equivalent to citric acid.

4. The bath composition as defined in claim 1 in which said cobalt ions are present in an amount of about 4 g/l and said zinc ions are present in an amount of about 3.5 g/l.

5. The bath composition as defined in claim 4 in which said complexing agent is present in an amount of about 40 g/l, calculated as a weight equivalent to citric acid.

6. The bath composition as defined in claim 1 or 2 in which said cobalt ions and said zinc ions are present in an amount to provide a mol ratio of cobalt to zinc ions of from about 0.8 to about 1.2:1.

7. The bath composition as defined in claim 1 or 2 in which said cobalt ions and said zinc ions are present in an amount to provide a mol ratio of cobalt to zinc ions of from about 0.9 to about 1.1:1.

8. The bath composition as defined in claim 1 or 2 in which said cobalt ions and said zinc ions are present in an amount to provide a mol ratio of cobalt to zinc ions of about 1:1.

9. The bath composition as defined in claim 1 in which said complexing agent comprises a compound selected from the group consisting of citric acid, gluconic acid, alpha glucoheptonic acid, tartaric acid, as well as the alkali metal, ammonium, cobalt and zinc salts thereof and mixtures thereof.

10. The bath composition as defined in claim 9 in which said complexing agent comprises citric acid in combination with at least one of gluconic acid, alpha glucoheptonic acid, tartaric acid and the alkali metal, ammonium, cobalt and zinc salts thereof.

11. The bath composition as defined in claim 10 in which the citric acid complexing agent is present in an amount of at least 5 g/l, calculated as a weight equivalent to citric acid.

12. The bath composition as defined in claim 10 in which said complexing agent comprises at least 10 g/l citric acid or the salt thereof, calculated as a weight equivalent to citric acid.

13. The bath composition as defined in claim 1 in which said complexing agent comprises predominantly citric acid or the salts thereof.

14. The bath composition as defined in claim 1 in which said complexing agent is present in an amount of about 10 to about 100 g/l, calculated as a weight equivalent to citric acid.

15. The bath composition as defined in claim 1 having a pH of about 8.

16. The bath composition as defined in claim 1 in which said complexing agent comprises citric acid, the alkali metal, ammonium, cobalt or zinc salts thereof and mixtures thereof.

17. The bath composition as defined in claim 1 further including a bath soluble compatible conductivity salt.

18. The bath composition as defined in claim 17 in which said conductivity salt is present in an amount up to about 50 g/l.

19. The bath composition as defined in claim 17 in which said conductivity salt is present in an amount of about 20 to about 40 g/l.

20. The bath composition as defined in claim 1 further including a bath soluble and compatible pH adjusting agent.

21. The bath composition as defined in claim 1 containing about 4 g/l cobalt ions, about 3.5 g/l zinc ions, about 40 g/l complexing agent, calculated as a weight equivalent to citric acid, said bath having a pH of about 8.

22. The bath composition as defined in claim 21 in which said complexing agent comprises citric acid, the alkali metal, ammonium, cobalt, or zinc salts thereof and mixtures thereof.

23. The method of electrodepositing a cobalt-zinc alloy on a conductive substrate to impart a simulated chromium appearance thereto, comprising the steps of contacting the substrate with an aqueous electrolyte at a pH of about 6 to about 9, containing about 1 to about 12 g/l cobalt ions, about 0.75 to about 9 g/l zinc ions, a complexing agent present in an amount sufficient to maintain said cobalt and said zinc ions in solution, controlling the ratio of said cobalt and zinc ions in said electrolyte to electrodeposit a cobalt-zinc alloy containing about 75 to about 85% by weight zinc and the balance essentially cobalt, and electrifying said substrate while in contact with said electrolyte to deposit a cobalt-zinc alloy plating of the desired thickness.

24. The method as defined in claim 23 including the further step of controlling said electrolyte within a temperature of about 60° to about 90° F.

25. The method as defined in claim 23 including the further step of controlling said electrolyte within a temperature of about 70° to about 80° F.

26. The method as defined in claim 23 including the further step of controlling said electrolyte at a temperature of about 75° F.

27. The method as defined in claim 23 in which said complexing agent in said electrolyte comprises a compound selected from the group consisting of citric acid, gluconic acid, alpha glucoheptonic acid, tartaric acid, the alkali metal, ammonium, cobalt, and zinc salts thereof as well as mixtures thereof.

28. The method as defined in claim 27 in which said complexing agent comprises citric acid and said salts thereof.

29. The method as defined in claim 27 in which said complexing agent comprises citric acid and said salts thereof in combination with at least one of gluconic acid, alpha glucoheptonic acid, tartaric acid and said salts thereof.

30. The method as defined in claim 27 in which said complexing agent comprises sodium glucoheptonate and the step of electrifying said substrate is performed in an electroplating barrel.

31. The method as defined in claim 23 in which the step of electrifying said substrate is performed to provide a current density of about ½ to about 30 ASF.

32. The method as defined in claim 23 in which the step of electrifying said substrate is performed by placing said substrate on a rack.

33. The method as defined in claim 23 in which said electrolyte contains about 3 to about 8 g/l cobalt ions, about 2.5 to about 6 g/l zinc ions, about 20 to about 75 g/l complexing agent, said electrolyte having a temperature of about 70° to about 80° F.

34. The method as defined in claim 23 in which said cobalt ions are present in an amount of about 4 g/l, said zinc ions are present in an amount of about 3.5 g/l, said complexing agent is present in an amount of about 40 g/l, said bath having a temperature of about 75° F., a pH of about 8, and said step of electrifying said substrate is performed at a current density of about 10 to about 15 ASF.

35. The method as defined in claim 34 in which said complexing agent comprises citric acid and the alkali metal, ammonium, cobalt, or zinc salts thereof and mixtures thereof.

36. The method as defined in claim 23 including the further steps of water rinsing said substrate with said deposit of cobalt-zinc alloy thereon and subjecting the plated said substrate to a passivation treatment.

37. The method as defined in claim 36 in which said passivation treatment comprises contacting the plated said substrate with a dilute aqueous chromium containing rinse solution.

38. The method as defined in claim 37 in which said aqueous chromium containing rinse solution contains about 3 to about 15 g/l of a chromate or dichromate salt.

39. The method as defined in claim 37 including the further step of controlling the temperature of said aqueous chromium containing rinse solution within a range of about 60° to about 120° F.

40. The method as defined in claim 37 including the further step of controlling the period of said contacting within a range of about 5 to about 30 seconds.

* * * * *